United States Patent [19]

Smith et al.

[11] 4,097,641

[45] Jun. 27, 1978

[54] FLAME RETARDANT FINISHES FOR TEXTILE MATERIALS

[75] Inventors: Ray E. Smith; James A. Albright, both of Ann Arbor, Mich.

[73] Assignee: Velsicol Chemical Corporation, Chicago, Ill.

[21] Appl. No.: 748,957

[22] Filed: Dec. 9, 1976

Related U.S. Application Data

[63] Continuation-in-part of Ser. No. 660,520, Mar. 22, 1976, Pat. No. 4,015,037, and Ser. No. 660,500, Feb. 23, 1976.

[51] Int. Cl.[2] ..... C09D 1/00

[52] U.S. Cl. ..... 428/245; 8/116 P; 106/15 FP; 252/8.1; 428/264; 428/265; 428/267; 428/277; 428/921

[58] Field of Search ..... 252/8.1; 106/15 FP; 428/245, 264, 265, 267, 277, 921; 8/116 P

[56] References Cited

U.S. PATENT DOCUMENTS

| | | | |
|---|---|---|---|
| 3,729,434 | 4/1973 | Todd | 252/8.1 |
| 4,046,701 | 9/1977 | Smith | 252/8.1 |

*Primary Examiner*—James J. Bell

*Attorney, Agent, or Firm*—Robert M. Phipps; Howard J. Greenwald

[57] ABSTRACT

Improved flame retardant concentrates and finishes containing triesters of pentavalent phosphorus acid having the general formula wherein X, X′ and X″ are hydrogen, chlorine and bromine; *a* is 0 or 1; *n* is an integer of from 1 to 7; *m* is an integer of from 1 to *n; b* is an integer of from 1 to 7; and *z* is an integer of from 1 to *b.*

45 Claims, No Drawings

FLAME RETARDANT FINISHES FOR TEXTILE MATERIALS

Cross-Reference to Related Applications

This application is a continuation-in-part of pending application Ser. No. 660,500, filed Feb. 23, 1976, and U.S. Pat. No. 4,015,037 Ser. No. 660,520, filed Mar. 22, 1976).

BACKGROUND OF THE INVENTION

1. Field of the Invention

This invention relates to flame retardant concentrates and flame retardant finishes containing certain third degree esters of phosphorus acid, i.e., compounds containing three P—O—C linkages, for flameproofing fabrics.

2. Description of the Prior Art

Recent years have witnessed a great interest in and a growing demand for flame retardant textiles and fabrics. However, the difficulties encountered in providing such a flame retardant compound are enormous. Firstly, the prior art has generally recognized the fact that polymer systems differ substantially in both flammability characteristics and physical properties and there is no predictability whatsoever from one system to another. Thus in the Norris et al. paper entitled "Toxicological and Environmental Factors Involved in the Selection of Decabromodiphenyl Oxide as a Fire Retardant Chemical", Applied Polymer Symposium No. 22, 195–219 (1973), the authors state: "A growing recognition of the huge annual toll taken by fire is resulting in more stringent flammability requirements for synthetic polymers in a variety of applications. Because of economic constraints and the need to produce flame resistant polymers without total replacement of existing manufacturing processes, increased flame resistance is generally achieved by incorporation of a fire retardant chemical in the finished product. This chemical is usually based on bromine, chlorine, phosphorus, or nitrogen and may either be chemically reacted or physically blended into the product. Since polymer systems differ markedly in both flammability characteristics and physical properties, selection of a suitable flame retardant depends on a variety of factors that severely limits the number of acceptable materials."

The resultant disadvantages in the utilization of various prior art materials as flame retardants, in general, include, without limitation, factors such as light instability, toxicity, discoloration, heat instability, the large amounts employed in order to be effective, and the unpredictable end results obtained when using the same material in different materials (note, for example, in *Modern Plastics Encyclopedia,* page 650, wherein octabromobiphenyl is suitable for use in polyolefins as a flame retardant therefor, but is not shown for use—or functionally equivalent—as such for the other 27 compositions listed such as ABS; polycarbonates, polystyrene, acrylics and polyurethanes.

While the prior art in general suggests the use of halogen-containing materials as "potential" or "possible" flame retardants for various materials, the prior art also recognizes that any material must be adjudged on a case by case basis because of the unpredictable results of the end product when any additive is incorporated therein. For example, with reference to the use of a halogenated fire retardant in U.S. Pat. No. 33,658,634, attention is directed to the fact that the patentee specifically points out the disadvantages in the use of a halogen-containing fire retardant. Thus, in column 1, lines 39–44, the patentee states: ". . . the compounds containing chlorine or bromine atoms to be used as fire-retardant agents are unstable in most cases when exposed to ultraviolet rays." In column 1, lines 59–64 the patentee goes on to say: "However, as a matter of fact, only very few fire-retardant polymers can be used in actual practice although they are said to have fire-retardant effects, because there are restrictions such as the conditions employed in production attributable to the properties of the fire-retardant agent, or to the properties of the polymers into which they are incorporated. "

A relevant example of the unpredictability of the efficacy of various compounds as flame retardants in different systems can be found in the case of cotton, polyester, and polyester/cotton fabrics. Thus, although satisfactory flame retardants are available for 100% cotton cotton fabrics and 100% polyester fabrics, entirely satisfactory flame retardants have not hitherto been available for polyester/cotton blend fabrics. This phenomena is in part due to the fact that "(c)hemical systems which have been developed for flame retardant finishing of 100% cellulosics are not necessarily effective in imparting self-extinguishing behavior to fabrics containing cellulosic and polyester fibers. " G. C. Tesoro, "Status and Prospects for Flame Resistant Polyester/Cellulose Blend Fabrics," 39, National Technical Information Service, Springfield, Va., 1973. Also "(t)here are significant differences in the extent to which organophosphorus systems found to be effective flame retardants for cellulose maintain this effectiveness in the presence of polyester." Ibid., 39.

In "Progress in the Development of Flame-Resistant Polyester-Cotton Blends", Proceedings of the 1974 Symposium on Textile Flammability, 116, Le Blanc Research Corporation, 5454 Post Rd., East Greenwich, R.I., 1974, W. A. Reeves et al. state that "(s)atisfactory flame retardants are available for cotton fabrics and polyester fabrics but are not available for polyester/cotton blend fabrics." Although "(s)ome flame retardants for cellulosic fibers are equally effective on polyester and vice-versa if one is only interested in flame resistance," "(p)roperties such as aesthetics and durability to laundering are often lacking in treated fabrics."

Thus, it can be seen that the field of flame retardancey is highly sophisticated and consequently requires sustained research effort to achieve a particular desired end result.

Secondly, the area of the present invention is further complicated in that not only must the compound act as a fire-retardant on fabrics treated therewith, but the compound also should be considered, according to some criteria and by some workers in the art, substantially mutagencially inactive. Thus, while certain haloalkyl phosphates are known flame retardants for various plastic compositions, i.e., films, molded articles, foams, and the like, see U.S. Pat. No. 3,132,169; U.S. Pat. No. 3,287,266; U.S. Pat. No. 3,324,205; and U.S. Pat. No. 3,830,886, many of these prior art compounds are considered, according to certain criteria used by some workers in the art, mutagenic and, therefore, not suitable for use as flame-proofing agents for wearing apparel which comes in intimate contact with the skin.

SUMMARY OF THE INVENTION

An improved flame retardant finished and flame retardant concentrate containing a flame retardant compound of the general formula

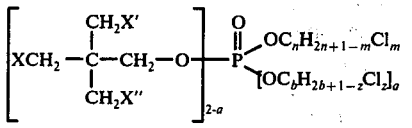

wherein X, X' and X'' are hydrogen, chlorine and bromine; *a* is 0 or 1; *n* is an integer of from 1 to 7; *m* is an integer of from 1 to *n; b* is an integer of from 1 to 7; and *z* is an integer of from 1 to *b.*

DESCRIPTION OF THE PREFERRED EMBODIMENTS

The flame retardant finishes of the present invention are composed of several constituent parts. In one embodiment the flame retardant finishes are comprised of at least four constituent parts. These finishes may be characterized as solvent containing emulsions. One of the constituent parts is a triester of pentavalent phosphorus acid having the general formula:

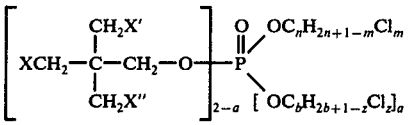

(I)

wherein X, X' and X'' are hydrogen, chlorine and bromine; *a* is 0 or 1; *n* is an integer of from 1 to 7; *m* is an integer of from 1 to *n; b* is an integer of from 1 to 7; and *z* is an integer of from 1 to *b.* The preferred lower alkyls are those having from 1 to about 4 carbon atoms. The preferred lower chloroalkyls are those having from 1 to about 4 carbon atoms and from 1 to about 3, preferably 1, chlorine substituents.

A preferred class of compounds, as regards hydrolytic stability and flame retardant efficacy, are those compounds of formula I wherein *a* is 1, i.e., those having the general formula

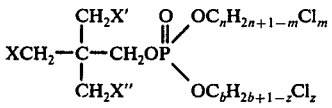

(IA)

wherein X, X', X'', *n, m, b* and *z* are as defined above.

Of the compounds of formula IA those having the general formula

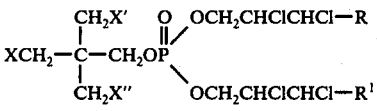

(IB)

wherein X, X' and X'' are as defined above, and wherein R and R' are hydrogen, alkyl, and chlorinated alkyl groups, wherein each alkyl group contains from 1 to 3 carbon atoms and each chlorinated group contains from 1 to about 3 chlorine substituents; and

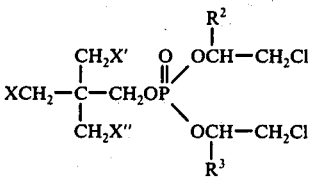

(IC)

wherein X, X' and X'' are as defined above; and $R^2$ and $R^3$ are hydrogen, chlorine, methyl and chloromethyl, are more preferred.

Compounds having the general formula (IC) are most preferred in the practice of the present invention.

Some examples of these most preferred compounds, with exemplary definitions of X, X',X'', $R^2$ and $R^3$ are listed in Table I below.

TABLE I

| Compound No. | X | X' | X'' | $R^2$ | $R^3$ |
|---|---|---|---|---|---|
| 1 | Cl | Br | Br | H | H |
| 2 | Cl | H | H | $-CH_2Cl$ | $-CH_2Cl$ |
| 3 | Br | Br | Br | $-CH_2Cl$ | $-CH_2Cl$ |
| 4 | Cl | Cl | Cl | $-CH_3$ | $-CH_3$ |
| 5 | Cl | Br | Br | $-CH_2Cl$ | $-CH_2Cl$ |
| 6 | Cl | H | H | H | H |
| 7 | H | H | H | $-CH_2Cl$ | $-CH_2Cl$ |
| 8 | Cl | H | H | $-CH_3$ | H |
| 9 | Cl | Br | Cl | $-CH\ Cl$ | $-CH_3$ |
| 10 | Br | H | H | $-CH_3$ | H |

Generally, compounds of formula I, specifically the more preferred compounds of formula IC, can be prepared in known manner by (1 ) reacting phosphoryl chloride with a neopentyl alcohol of the general formula

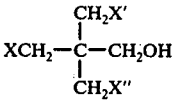

wherein X, X' and X'' are as defined above to form a dichlorophosphate of the general formula

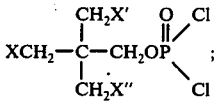

(II)

and (2) reacting the dichlorophosphate of formula II with an epoxide having the general formula

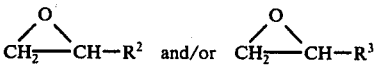

wherein $R^2$ and $R^3$ are as defined above, to form the compounds of formula IC An alternate method for preparing certain compounds falling within the scope of formula I generally, and within the scope of formula IB specifically, comprises: (1) reacting a glycol of the general formula

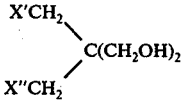

with phosphorus trichloride to form compound of the general formula

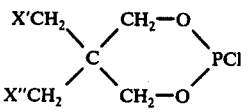

(III)

wherein X' and X'' are as defined above; (2) reacting compounds of formula III with chlorine to cleave the cyclic structure of formula III and form a compound having the general formula

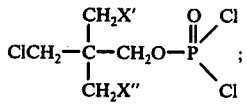

(IV)

and (3) reacting compound IV with appropriate epoxides of the formula

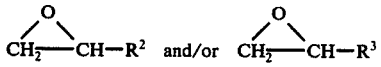

to form compounds of the formula

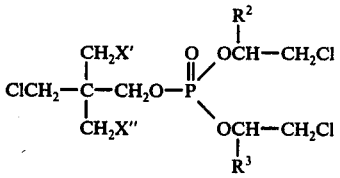

The above reactions generally proceed quite readily and usually no special reaction conditions or chemical processing equipment need be employed. These reactions can generally be conducted at room temperatures, temperatures above ambient, and temperatures below ambient. Elevated temperature may be used to insure completion of the reaction, although some of the foregoing addition reactions are generally exothermic and it may be advisable, at least initially, to use external cooling. It is usually preferable to employ solvents such as halogenated hydrocarbons like methylene chloride and chlorobenzene. The amount of reactants used is preferably stoichiometric, although an excess of reactants can be used. While the presence of a catalyst is usually not mandatory one may be used to decrease reaction times and allow the use of milder reaction conditions.

These fire retardant compounds are mutagenically inactive according to the results of the Ames Test which is considered by some workers in the art to be predictive of potential mutagenicity. Thus, for example, compounds 2 and 5 in Table I, when tested for mutagenicity in accordance with the Ames Test, using Salmonella typhimurium, strains TA-1535, TA-1537, TA-1538, TA-98, and TA-100 and Saccharomyces cerevisiae, strain Δ 4, as indicator organisms, were shown by said Ames Test to be mutagenically inactive. However, a compound structurally quite similar to compounds of formula I but falling outside the scope of formula I, e.g.,

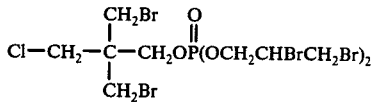

when subjected to the same Ames Test using the same indicator organisms was shown, according to said Ames Test results, to be mutagenically active or mutagenic.

A second constituent part of the flame retardant finishes of the present invention is an emulsifying agent. According to McCutcheon's "Detergents and Emulsifiers" (1975 edition) there are over 3,000 surface active agents available in the market place with over 300 producers. Thus some means for screening and/or testing should be provided to determine the type of surfactants or emulsifying agents suitable for the present invention. Emulsification may be defined as the ability to bring two immiscible liquids into intimate contact with one another, through the reduction of their interfacial tensions. Emulsions can be of varying stability and usually are susceptible to changes in pH, temperature, or other factors. To form stable concentrates which, in turn, yield stable and satisfactory aqueous emulsions of the flame retarding agents mentioned hereinabove, it has been found necessary that the emulsifier (1) should be substantially completely soluble in the flame retardant compound, and (2) has a hydrophile lipophile balance (HLB) of 10–14.

By way of illustration, and not intended to be a limitation on the scope of this invention, two general classes of emulsifiers are particularly useful in the practice of the present invention. The first of these comprises phosphated nonionic emulsifiers and phosphated nonionic emulsifiers blended with another emulsifier selected from the group consisting of aliphatic and aromatic nonionic emulsifiers. Said phosphated nonionic emulsifiers and phosphated nonionic emulsifier blends preferably have an acid number of from about 30 to about 130, preferably from about 48 to 120, and a phosphorus content of from about 2 percent to about 5 percent, preferably from about 2.2 percent to about 4 percent. Exemplary emulsifying agents of this class include but are not limited to, a blend of phosphated nonionic and unphosphated nonionic having an acid number of about 49.1 and a phosphorus content of about 2.31 percent and a phosphated nonionic having an acid number of about 118 and a phosphorus content of about 3.9 percent.

A second general class of emulsifiers comprises blends of oil soluble metal sulfonates and polyoxyethylene ethers. Any oil soluble metal sulfonate capable of blending with a polyoxyethylene ether is acceptable. The preferred type, however, is the calcium salt because the calcium ions appear to enhance the solubility of the sulfonate in hydrocarbons and further have some beneficial effects on the ether portion of the blend. In this connection it should be pointed out that the blend comprises a nonionic portion, i.e., polyoxyethylene ether and an anionic portion, i.e., metal sulfonate. The ratio of these two portions may vary from one application to another but the (HLB) value must fall within the range 10–14.

The hydrophile lipophile balance (HLB) provides one means of measuring the size and strength of the hydrophilic and lipophilic groups of the emulsifier. All emulsifiers possess both hydrophilic and lipophilic groups, although blends of emulsifiers can be used so that individual numbers of the blend may differ from each other. Generally speaking, an emulsifier which is lipophilic is characterized by a low HLB number (below 10) and one that is hydrophilic by a high HLB number (above 10). The scale runs from 0 to 20. However, those emulsifiers within the range of 9–11 might be considered intermediate in nature. Thus when an oil in water type emulsion is desired for the final product, as in the case for the present invention, water soluble groups should predominate and the emulsifier should have a relatively high (HLB) number. This can be effected by adjusting the components of the blend to yield the desired value. Such adjustments can be carried out when it is appreciated that the anionic portion of the blend comprises a potentially strong hydrophilic moiety in the negatively charged sulfonate group. Thus the more soluble the metal sulfonate the more hydrophilic. But because of other important factors dealing with the emulsification of the flame retardant sulfonates of moderate solubility are much preferred, i.e., the alkaline earth salts, particularly calcium.

Influenced by similar factors the nonionic portion of the blend is made moderately hydrophilic. Even though the polyoxyethylene ethers beat no charge when dissolved or dispersed in aqueous media, they still have hydrophilic tendency. Any oxygen present in the nonionic portion which is capable of hydration will enhance its hydrophilic property. Thus in the case of the polyoxyethylene ethers, the more ether linkages the greater the hydrophilic tendency and consequently the higher the (HLB) value.

The HLB number of most emulsifying agents is published information although it can be measured by laboratory procedures if necessary or desirable. Such methods together with more detailed information concerning the HLB systems, are set forth in "The Atlas HLB System," 4th Printing, Atlas Chemical Industries, Inc., Wilmington, Del.

Based on the above teachings, it can be seen that a chemist of ordinary skill in the art will become aware of the particular properties expected of the emulsifier and consequently know the components without much difficulty. For example, the oil soluble metal sulfonate can be a salt of an alkylbenzenesulfonate, e.g., calcium salts of dodecylbenzenesulfonic or tridecylbenzenesulfonic acids. As to the nonionic portion of the emulsifier blend a polyoxyethylene ether containing from 2 to 16 moles of oxyethylene may be used. For further assistance in formulation, chemical designation or description reference is made to a comprehensive article by W. C. Griffin, Encyclopedia of Chemical Technology, edited by Kirt-Othmer. Second edition, volume 8, pp. 117–154. Also, see volume 19 of the same reference, pp. 507–593 wherein a detailed listing and theoretical discussion of the various surfactants are provided.

Preferred emulsifying agents generally posses a hydrophilie lipophile balance of from about 10 to about 14 and are selected from the group comprising (1) a nonionic/anionic blend of an isopropyl amine salt of dodecylbenzene sulfonic acid and an ethoxylated alcohol containing from 10 to 18 carbon atoms and (2) an oil soluble metal sulfonate and a polyoxyethylene ether blended in proportions such that the emulsifying agent possesses a hydrophile lipophile balance of from about 10 to about 14.

Generally, emulsifiers having the requisite properties are available commercially. For the purposes of practicing the present invention it has been found preferable to utilize any of the following commercial emulsifying agents: "Emcol" N-139B, "Emcol" H 141B, "Emcol" N-141B, "Emcol" 500B, or "Emcol" AD6-39A. These emulsifiers are blends of oil soluble calcium sulfonate and polyoxyethylene ethers. They have (HLB) values of 10.0, 12.5, 12.1, 13.0 and 13.5, respectively. Depending on the particular emulsifier used to form the concentrate it may be necessary to utilize deionized water to get the optimum emulsion as in the case of "Emcol" H-141B. Occasionally hard water is used in which case the emulsifier having the high (HLB) value should be used, but depending on the degree of hardness a blend of two or more emulsifiers may appear best. These "Emcol" emulsifiers are products of the Witco Chemical Co., Inc., Organic Division, Chicago, Ill.

It should also be specifically noted that it is possible to prepare emulsifying agents that come within the scope of this invention by blending an emulsifier having a hydrophile lipophile value of less than 10 with an emulsifier having a hydrophile lipophile value of greater than 14 to prepare a blended emulsifying agents, commonly referred to in the art as a "matched pair", having a hydrophile lipophile value of from about 10 to about 14.

A third constituent part of the flame retardant finish of this invention is an organic solvent. Some solvents which are generally useful in the practice of the present invention are hydrocarbons derived from petroleum such as benzene, toluene and xylenes, chlorinated hydrocarbons such as perchloroethylene and trichloroethylene; and ketones such as methyl ethyl ketone.

The preferred solvents, among other things, should (a) possess the ability to dissolve the flame retarding agents represented by the above structural Formulas I, IA, and IB;
(b) be immiscible with water or substantially so;
(c) have a specific gravity as low as possible, i.e., equal to or lower than water, if possible;
(d) have a flash point high enough to avoid shipping restrictions and other regulations, and to avoid difficulties from the safety point of view;
(e) have a boiling point low enough to permit removal of the solvent with water, but not so high as to cause it to remain in the material treated.

Preferably, the solvent should have an API gravity of about 30, a flash point of at least about 80° F. (Tag Closed Cup Method, ASTM) and a boiling point of 300° to 350° F. API gravity is related to the determination of specific gravity by an empirical equation. A procedure for measuring it by means of a glass hydrometer has been evolved for crude petroleum and liquid petroleum products, see ASTM Standards, Part 17, page 120 et seq. of the 1964 edition published by the American Society for Testing and Materials, Philadelphia, Pa. To enable, further, the selection of the correct organic solvent, in so far as its dissolving power is concerned, the kauri butanol number should be at least 85. The Kauri Butanol number (KB) provides a measure of the dissolving power of the solvent, said power being determined by adding the solvent under a standard set of conditions to a solution of kauri resin in butanol to produce a defined degree of turbidity—see ASTM Standards, Part 8, page 402 et seq. of the 1958 edition.

Various organic solvents or mixtures thereof can be formulated in the laboratory to provide a solvent or blend of solvents which is satisfactory for the practice of the present invention. For example, a mixture of 6 parts by weight of hexane to 8 parts by weight of toluene is satisfactory, although it has a rather low flash point. For commercial purposes, it is believed that a variety of petroleum solvents including mixtures thereof could be obtained which will have the requisite and desired properties. A solvent satisfying the requirements stipulated above is known as "LA30" which is a petroleum solvent having an API gravity of 29.7, a flash point of 112° F., a KB value of 92 and a boiling range of 316° to 330° F. "LA30" is a product sold by Leonard Refineries, Inc., Alma, Mich. Another solvent satisfying these requirements is known as Hi-Sol®10 which is comprised of 99% aromatics, has a specific gravity at 60° F. of 0.887–0.8654, a flash point of 110° F., and a Kauri-Butanol Value of 92. Hi-Sol®10 is a product sold by Ashland Chemical Company of Columbus, Ohio.

A fourth constituent part of the flame retardant finish is water.

In one embodiment the flame retardant finish generally comprises, in percent by weight, from about 2% to about 60% of the flame retardant compound, from about 2% to about 18% of the emulsifier, from about 0.4% to about 48% of the solvent, and from about 2.6% to about 97.4% of water; preferably from about 4% to about 12% of the emulsifier, from about 0.8% to about 32% of the solvent, and from about 5.2% to about 94.8% of water; and more preferably from about 5% to about 30% of the flame retardant compound, from about 0.5% to about 9% of the emulsifier, from about 1% to about 24% of the solvent, and from about 6.5% to about 93.5% of water. While the above ranges are those which produce a generally effective flame retardant finish it is to be understood that the present invention is meant to include a flame retardant finish containing an amount of flame retardant compound effective to impart flame retardant properties to the fabric treated with said flame retardant finish, i.e., the flame retardant finish contains a flame retardant amount of the flame retardant compound of formula I; an amount of emulsifying agent effective to form an emulsion of the flame retardant compound and water, i.e., an emulsifying amount of the emulsifier; and an amount of solvent effective to solvate the flame retardant compound in the emulsifying agent, i.e., a solvating amount of solvent.

Another embodiment of the present invention comprises solventless flame retardant finishes. These finishes may be characterized as substantially solvent free emulsions and are useful in situations wherein it is desired to have more of the flame retardant compound present in the emulsion; and with those compounds of formula I, such as for example compound 2 in Table I, which are relatively readily capable of forming stable aqueous emulsions. In this embodiment the flame retardant finish is comprised of the flame retardant compound of formula I, the aforedescribed emulsifying agent, and water. These flame retardant finishes generally contain, in percent by weight, from about 2% to about 60% of the flame retardant compound, from about 0.2% to about 18% of the emulsifier, and from about 22% to about 97.8% water; preferably from about 4% to about 40% of the flame retardant compound, from about 0.4% to about 12% of the emulsifier, and from about 4.8% to about 95.6% water; and more preferably from about 5% to about 30% of the flame retardant compound, from about 0.5% to about 9% of the emulsifier, and from about 61% to about 94.5% water.

Yet another embodiment of the present invention comprises substantialy non-aqueous flame retardant finishes. In this embodiment the flame retardant finishes contain substantially no water and no emulsifying agent and are comprised of the flame retardant compound of formula I and the organic solvent. In this embodiment the organic solvent is the carrier system. These substantially non-aqueous finishes are of particular utility in flameproofing fabrics such as velvet, sateens, velours and the like, which can be deleteriously affected by water. These non-aqueous finishes generally contain from about 2% to about 60% by weight of the flame retardant compound and from about 40% to about 98% of solvent; preferably from about 4% to about 40% of the flame retardant compounds and from about 60% to about 96% of the solvent; and more preferably from about 5% to about 30% of the flame retardant compound and from about 70% to about 95% of the solvent.

The flame retardant finishes of this invention can optionally have incorporated therein a wetting agent. If the wetting agent is a constituent part of said flame retardant finishes, the wetting agent would comprise from about 0.1 percent to about 1 percent, preferably from about 0.2 percent to about 0.8 percent, and more preferably about 0.5 percent of said flame retardant finishes. The wetting agents which can be employed in this invention can be selected from the group comprising anionic, nonionic and nonionic-anionic blend wetting agents. Exemplary wetting agents include an anionic phosphate surfactant in free acid form, a nonionic nonylphenyl polyethylene glycol ether, a nonionic octylphenoxy polyethoxy ethanol, a nonionic trimethyl nonyl polyethylene glycol ether, and a nonionic polyethylene glycol ether of linear alcohol. These and other wetting agents are well known to people skilled in the fabric treating art.

Also within the scope of this invention are flame retardant concentrates useful in formulating the aforedescribed flame retardant finishes. These concentrates may generally be classified as solvent containing emulsion concentrates useful in formulating the aforedescribed solvent containing emulsions, solventless emulsion concentrates useful in formulating the aforedescribed solventless emulsions, and substantially non-aqueous concentrates useful in formulating the aforedescribed substantially non-aqueous finishes.

The solvent containing emulsion concentrates comprise a flame retardant compound of formula I, an emulsifier, and an organic solvent. These emulsion concentrates generally contain, in percent by weight, from about 10% to about 90% of the flame retardant compound, from about 0.25% to about 45% of the emulsifying agent, and from about 0.5% to about 80% of the solvent; preferably from about 25% to about 80% of the flame retardant compound, from about 1.5% to about 25% of the emulsifying agent, and from about 3% to about 70% of the organic solvent; and more preferably from about 35% to about 75% of the flame retardant compound, from about 4% to about 15% of the emulsifying agent, and from about 8% to about 60% of the solvent.

The solventless emulsion concentrates comprise the flame retardant compound of Formula I and the aforedescribed emulsifying agent. These emulsion concentrates generally contain, in percent by weight, from about 20% to about 98% of the flame retardant compound and from 2% to about 80% of the emulsifying agent; preferably from about 30% to about 98% of the flame retardant compound and from about 2% to about 70% of the emulsifying agent; and more preferably from about 40% to about 95% of the flame retardant compound and from about 5% to about 60% of the emulsifying agent.

These emulsion concentrates can optionally have incorporated therein the aforedescribed wetting agent. If these emulsion concentrates contain a wetting agent, said agent would comprise from about 0.1% to about 1%, preferably from about 0.2% to about 0.8%, and more preferably about 0.6% of said flame retardant emulsion concentrates.

While the above components are usually present in the aforedescribed ranges in the emulsion concentrates of the present invention, it is to be understood that the amounts of the components may vary widely and still produce effective emulsion concentrates. Generally, the amount of flame retardant compound that is present in the emulsion concentrate is a flame retardant amount, i.e., an amount effective to provide flame retardant properties to the emulsion concentrate; the amount of emulsifying agent present in the emulsion concentrate is an emulsifying amount, i.e., an amount effective to emulsify the flame retardant compound; and the amount of solvent present, when there is solvent incorporated into the emulsion concentrate, is an amount effective to produce a solvating effect in the concentrate, i.e., an amount effective to solvate the flame retardant compound.

The substantially non-aqueous concentrates useful in formulating a substantially non-aqueous flame retardant finish contain substantially no water and no emulsifying agent. These concentrates comprise a flame retardant compound of formula I and the aforedescribed organic solvent. These concentrates contain a flame retarding amount of the flame retardant compound, i.e., an amount of flame retardant compound effective to provide flame retardancy thereto, and a solvating amount of the solvent, i.e., an amount of solvent effective to solvate the flame retardant compound. Generally, these concentrates contain from about 20% to about 99% of the flame retardant compound of Formula I and from 1% to about 80% of the solvent; preferably from about 30% to about 80% of the flame retardant compound and from 20% to about 70% of the solvent; and more preferably from about 40% to about 75% of the flame retardant compound and from about 25% to about 60% of the solvent.

The flame retardant emulsion concentrate can be readily produced by admixing the aforedescribed constituent parts, or in the case of the non-aqueous concentrate by admixing the flame retardant compound with the solvent. The flame retardant finishes can be readily formulated by adding the emulsion concentrate to water, or in the case of the non-aqueous finish the fire retardant compound-solvent concentrate to the same or a different organic solvent.

The flame retardant finish may be applied to textile fabrics by any of the commonly known methods prevalent in the art. Among these methods are atmospheric exhaustion, pressure exhaustion, and pad-dry-cure. The pad-dry-cure method has been found to be among those which produce superior results. In this method the temperature of the flame retardant finish during application should be maintained at from about 0° C. to about 27° C. and preferably from about 15° C. to about 21° C. If necessary, the desired temperature may be contained during the padding procedure by using any suitable heat transfer means such as circulating water through the jacket on the pad box containing the flame retardant finish.

The textile fabrics should be padded by suitable means such that the wet pick-up is generally from about 30 percent to about 150 percent, preferably from about 40 percent to about 130 percent, and more preferably from about 50 percent to about 90 percent of the weight of the untreated fabric. One suitable set of padding conditions includes padding the fabric at from about 6 to 10 tons of pressure using a 1 dip/1 nip or a 2 dip/2 nip fabric lacing and an immersion time of from about 10 to about 12 seconds followed by subjecting the treated fabric to squeezing means to obtain the desired set pick-up on the treated fabric.

The treated textile fabrics should be dried, preferably frame dried, slightly over the finished width, at from about 104° to about 127° C. and preferably from about 104° C. to about 110° C.

Curing of the dried fabrics can be done at from about 150° to about 205° C. for from about 90 seconds to about 480 seconds; preferably the curing will be done at about 180° C. for about 150 seconds or at 205° C. for about 90 seconds.

Although fabric drying and curing can take place simultaneously, it is preferred that separate drying and curing operations be performed.

Many textile fabrics may be treated with the flame retardant finishes of the present invention. Examples of such textile fabrics include cellulosics, rayon, acrylics, polyesters, acetates, nylon, and textile fabrics derived from animal fibers, such as wool and mohair, and blends thereof. Typical blends include 35/65, 50/50 and 63/35 blends of polyester/cotton, 50/50 blend of polyester/-rayon, and 50/50 blend of acrylic/cotton.

The following examples are presented by way of further illustration of the invention and should not be construed as limiting. All parts and percentages including those in the example are by weight unless otherwise indicated.

EXAMPLE 1

An emulsion concentrate was prepared by mixing together 500.0 grams of bis(1,3-dichloro-2-propyl)-2,2-dimethyl-3-chloropropyl phosphate and 55.5 grams of an emulsifier comprised of nonionic organic phosphate ester possessing a hydrophile lipophile balance of from about 10 to 14; i.e., AM2-10C, produced by Witco Chemical Co., Inc.

EXAMPLE 2

A flame retardant finish was prepared by mixing 333.3 grams of the emulsion concentrate of Example 1 with 1166.7 grams of water with stirring until a stable emulsion was formed.

EXAMPLE 3

A substantially non-aqueous flame retardant finish was prepared by mixing 120 grams of bis(1,3-dichloro-2-propyl) tribromoneopentyl phosphate with 480 grams of xylene.

EXAMPLE 4

An emulsion concentrate was prepared by mixing 248 grams of bis(1,3-dichloro-2-propyl)-3-chloro-2,2-dibromomethyl-1-propyl phosphate; 50 grams of an emulsifier comprised of an oil soluble metal sulfonate and a polyoxyethylene ether blended in proportions such that the emulsifying agent possesses a hydrophile lipophile balance of from about 10 to 14, such as emulsifier is Emcol N-141B® produced by Witco Chemical Co., and 198.4 grams of solvent comprised of 99% aromatics, having a specific gravity at 60° F. of 0.887–0.8654, a flash point of 110° F., and a Kauri-Butanol Value of 92; such a solvent is Hi-Sol® produced by Ashland Chemical Company of Columbus, Ohio.

EXAMPLE 5

A flame retardant finish was prepared by adding 240 grams of the emulsion concentrate of Example 4 to 360 grams of water with stirring until a stable emulsion was formed.

EXAMPLE 6

Samples of 100% polyester fabric (Style #755 Testfabric, Inc., Middlesex, N.J.) were treated with the finishing formulation of Example 5 by a pad, dry, cure procedure. The fabrics were dried for 5 minutes at 105° C. and thereafter cured for 90 seconds at 205° C. The cured fabric was then washed for 12 minutes in a bath containing water, 0.05% detergent and 0.10% soda ash maintained at about 120° F., rinsed and tumble dried.

EXAMPLE 7

Samples of a 100% polyester fabric (Style #755 Testfabric, Inc., Middlesex, N.J.) were treated with the flame retardant finish of Example 2 by a pad, dry, cure procedure. The fabrics were dried for 5 minutes at 105° C. and thereafter cured for 90 seconds at 205° C. The cured fabrics were then washed for 10 minutes in a bath containing water, 0.05% detergent and 0.10% soda ash and maintained at about 120° F., rinsed and tumble dried.

EXAMPLE 8

Samples of a 100% polyester fabric (Style #755 Testfabric, Inc., Middlesex, N.J.) were treated with the substantially non-aqueous flame retardant finish of Example 3 by a pad, dry, cure procedure. The cured fabric was then washed for 10 minutes in a bath containing water, 0.05% detergent and 0.01% soda ash and maintained at about 120° F., rinsed and tumble dried. The wet pick-up of the finish, based on the weight of the fabric, was 71.6%.

EXAMPLE 9

The flame retardancy of the treated fabrics of Examples 6, 7, and 8, as well as of an untreated fabric, was evaluated using the specimen condition procedures established by the "Standard for the Flammability of Children's Sleepwear", U.S. Department of Commerce FF 3-71 (DOC 3-71). The durability of the flame retardant treatment was determined by measuring the char lengths of the treated fabrics after washing and after 50 laundering and drying cycles in a Heltra combination washer and dryer.

The flame retardancy of the fabrics was determined by a vertical burn test on specimens of fabric in which a double zig-zag stitch of a polyester thread finished with silicone was sewn up the middle of the specimen. An airless methane gas flame was impinged on the seam for 3 seconds and the char length was measured and the char length data is shown initially and after 50 Heltra laundering and drying cycles. Char length data for the untreated fabric and the treated fabrics of Examples 6, 7 and 8 are shown in the following Table II.

TABLE II

| | Char Length, Inches Laundering and Drying Cycles | |
|---|---|---|
| | | 50 |
| Untreated | BEL[1] | BEL |
| Example 6 | 2.8 | 3.4 |
| Example 7 | 3.0 | 5.9 |
| Example 8 | 2.5 | 3.0 |

[1]BEL - Specimen burned the entire length.

The above specification as well as the examples contained therein clearly establish that the novel flame retardant finishes of this invention are capable of rendering textile materials treated therewith flame retardant, i.e., capable of passing the DOC FF 3-71 flammability test, while not significantly presenting any of the problems associated with mutagenicity commonly encountered with some common flame retardants, i.e., the compounds described herein are substantially non-magnetic as determined by the Ames Test for mutagenicity. In view of the need for an effective commercial flame retardant which is considered non-mutagenic and which is capable of meeting the requirements of DOC FF 3-71 the present invention, which provides such a flame retardant, must truly be considered a great advance in the art.

Illustrated bellow in Example 10 is the presentation of one of the compounds, bis(dichloropropyl)-2,2-dimethyl-3-chloropropyl phosphate, useful in practicing the present invention.

EXAMPLE 10

To a suspension containing 200 ml of methylene chloride and 145.6 gms of neopentyl glycol was added, dropwise, 192.4 gms of phosphorus trichloride while the reaction mixture was maintained at 10° C. After addition of the phosphorus trichloride was completed the reaction mixture was heated to 35° C. and maintained at this temperature for ½ hour. Methylene chloride was then removed from the reaction mixture under vacuum. The temperature of the reaction mixture was then lowered to below 20° C. and chlorine gas was introduced until the reaction mixture was yellow in color. The excess chlorine was then removed and a titanium tetrachloride catalyst was introduced. The reaction mixture was then heated to 80° C. and 259 gms of epichlorohydrin was added dropwise. The reaction mixture was maintained at 80° C. for 1 hour after addition of epichlorohydrin was complete. The resulting product was washed with aqueous ammonia followed by two washings with deionized water. The product was dried under vacuum and filtered hot to yield 542 gms of a clear liquid which was substantially bis(dichloropropyl)-2,2-dimethyl-3-chloropropyl phosphate (compound 2 in Table I).

Based on this disclosure, many other modifications and ramifications will naturally suggest themselves to those skilled in the art. These are intended to be comprehended as within the scope of this invention.

The embodiments of the invention in which an exclusive property or privilege is claimed are defined as follows:

1. A flame retardant textile finish consisting essentially of:

(i) from about 2 to about 60 percent (by weight) of a flame retardant compound of the formula

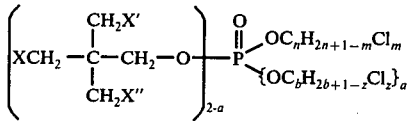

wherein X,X′ and X″ are hydrogen, chlorine and bromine; $a$ is 0 or 1; $n$ is an integer of from 1 to 7; $m$ is an integer of from 1 to $n$; $b$ is an integer of from 1 to 7; and $z$ is an integer of from 1 to $b$;

(ii) from about 2 to about 18 percent (by weight) of an emulsifying agent;

(iii) from about 2.6 to about 97.4 percent (by weight) of water; and (iv) from about 0.4 to about 48 percent of an organic solvent.

2. The finish of claim 1 wherein $a$ is 1, and wherein said finish consists essentially of from about 5 to about 30 percent (by weight) of said flame retardant compound, from about 4 to about 12 percent (by weight) of said emulsifying agent, from about 5.2 to about 94.8 percent (by weight) of water, and from about 0.8 to about 32 percent by weight) of said organic solvent.

3. The flame retardant finish of claim 2 wherein the flame retardant compound has the formula

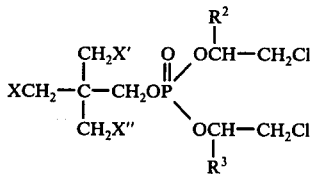

wherein X, X′, and X″ are as defined above; and $R^2$ and $R^3$ are independently selected from hydrogen, chlorine, methyl, and chloromethyl; and wherein said finish consists essentially of said flame retardant compound, from about 0.5 to about 9 percent (by weight) of said emulsifier, from about 6.5 to 93.5 percent (by weight) of water, and from about 1 to about 24 percent (by weight) of said solvent.

4. The flame retardant finish of claim 3 wherein the emulsifying agent possesses a hydrophile liphophile balance value of from about 10 to about 14.

5. The flame retardant finish of claim 3 which also contains from about 0.1 to about 1 percent (by weight) of wetting agent.

6. The flame retardant finish of claim 3 wherein X is chlorine, X′ and X″ are bromine, and $R^2$ and $R^3$ are hydrogen.

7. The flame retardant finish of claim 3 wherein X is chlorine, X′ and X″ are hydrogen, and $R^2$ and $R^3$ are chloromethyl.

8. The flame retardant finish of claim 3 wherein X, X′ and X″ are bromine, and $R^2$ and $R^3$ are chloromethyl.

9. The flame retardant finish of claim 3 wherein X, X′ and X″ are chlorine, and $R^2$ and $R^3$ are methyl.

10. The flame retardant finish of claim 3 wherein X is chlorine, X′ and X″ are bromine, and $R^2$ and $R^3$ are chloromethyl.

11. A solventless flame retardant finish consisting essentially of:

(i) from about 2 to about 60 percent (by weight) of the flame retardant compound of the formula

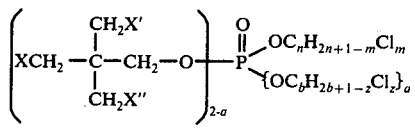

wherein X, X′ and X″ are hydrogen, chlorine and bromine; $a$ is 0 or 1; $n$ is an integer of from 1 to 7; $m$ is an integer of from 1 to $n$; $b$ is an integer of from 1 to 7; and $z$ is an integer of from 1 to $b$;

(ii) from about 0.2 to about 18 percent (by weight) of an emulsifying agent;

(iii) from about 22 to about 97.8 percent (by weight) of water.

12. The flame retardant finish of claim 11 wherein:

(i) said finish consists essentially of from about 4 to about 40 percent (by weight) of said flame retardant, from about 0.4 to about 12 percent (by weight) of said emulsifier, and from about 4.8 to about 95.6 percent (by weight) of water;

(ii) $a$ is 1; and (iii) said flame retardant compound has the formula:

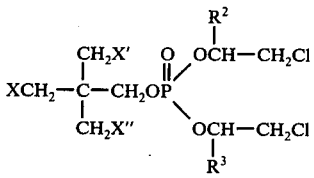

wherein X, X′ and X″ are independently selected from a group consisting of hydrogen, chlorine, and bromine; and $R^2$ and $R^3$ are independently selected from hydrogen, chlorine, methyl and chloromethyl.

13. The flame retardant finish of claim 12 wherein said finish consists essentially of from about 5 to about 30 percent (by weight) of said flame retardant, from about 0.5 to about 9 percent (by weight) of said emulsifying agent, and from about 61 to about 94.5 percent (by weight) of water.

14. The flame retardant finish of claim 12 wherein X is chlorine, X′ and X″ are bromine, and $R^2$ and $R^3$ are hydrogen.

15. The flame retardant finish of claim 12 wherein X is chlorine, X′ and X″ are hydrogen, and $R^2$ and $R^3$ are chloromethyl.

16. A textile material containing an amount of the flame retardant finish of claim 1 effective to render said textile material flame retardant.

17. The textile material of claim 16 wherein said textile is selected from the group consisting of cellulosics, rayon, nylon, acrylics, polyesters and textile fabrics derived from animal fibers, and blends thereof.

18. A textile material containing an amount of the flame retardant finish of claim 11 effective to render said textile material flame retardant.

19. The textile material of claim 18 wherein said textile is selected from the group consisting of cellulosics, rayon, nylon, acrylics, polyesters and textile fabrics derived from animal fibers, and blends thereof.

20. A substantially non-aqueous flame retardant finish consisting essentially of:

(i) from about 2 to about 60 percent (by weight) of a flame retardant compound of the formula

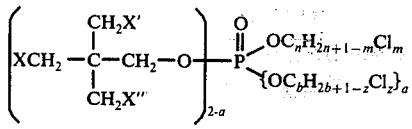

wherein X, X' and X'' are hydrogen, chlorine and bromine; $a$ is 0 or 1; $n$ is an integer of from 1 to 7; $m$ is an integer of from 1 to $n$; $b$ is an integer of from 1 to 7; and $z$ is an integer of from 1 to $b$; and (ii) from about 40 to about 98 percent (by weight) of an organic solvent.

21. The finish of claim 20 wherein said organic solvent is substantially water immiscible.

22. The finish of claim 21 wherein said organic solvent has a flash point of at least 80° F. and a boiling point within the range of from about 300° to 350° F.

23. The finish of claim 20 wherein $a$ is 1.

24. The finish of claim 23 wherein the flame retardant compound has the formula

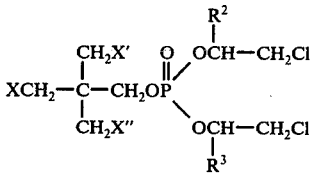

wherein X, X' and X'' are as aforedefined; and $R^2$ and $R^3$ are independently selected from hydrogen, chlorine, methyl and chloromethyl.

25. The finish of claim 24 wherein X is chlorine, X' and X'' are bromine, and $R^2$ and $R^3$ are hydrogen.

26. The finish of claim 24 wherein X is chlorine, X' and X'' are hydrogen, and $R^2$ and $R^3$ are chloromethyl.

27. The finish of claim 24 wherein X, X' and X'' are bromine, and $R^2$ and $R^3$ are chloromethyl.

28. The finish of claim 24 wherein X, X' and X'' are chlorine, and $R^2$ and $R^3$ are methyl.

29. The finish of claim 24 wherein X is chlorine, X' and X'' are bromine, and $R^2$ and $R^3$ are chloromethyl.

30. A textile material containing an amount of the flame retardant finish of claim 20 effective to render said textile material flame retardant.

31. The textile material of claim 30 wherein said textile is selected from the group consisting of cellulosics, rayon, nylon, acrylics, polyesters and textile fabrics derived from animal fibers, and blends thereof.

32. A flame retardant emulsion concentrate consisting essentially of:

(i) from about 10 to about 90 percent (by weight) of a flame retardant compound of the formula

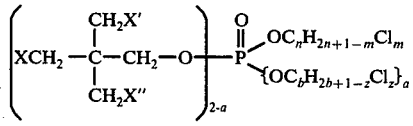

wherein X, X' and X'' are hydrogen, chlorine and bromine; $a$ is 0 to 1; $n$ is an integer of from 1 to 7; $m$ is an integer of from 1 to $n$; $b$ is an integer of from 1 to 7; and $z$ is an integer of from 1 to $b$;

(ii) from about 0.25 to about 45 percent (by weight) of an emulsifying agent; and (iii) from about 0.5 to about 80 percent (by weight) of an organic solvent.

33. The emulsion concentrate of claim 32 wherein $a$ is 1.

34. The flame retardant emulsion concentrate of claim 33 wherein the flame retardant compound has the general formula

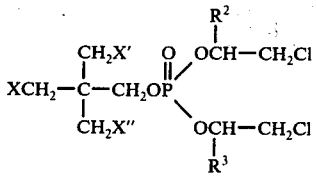

wherein X, X' and X'' are as defined above; and $R^2$ and $R^3$ are independently selected from hydrogen, chlorine, methyl and chloromethyl.

35. The flame retardant emulsion concentrate of claim 34 wherein the emulsifying agent possesses a hydrophile lipophile balance value of from about 10 to about 14.

36. The emulsion concentrate of claim 34 wherein X is chlorine, X' and X'' are bromine, and $R^2$ and $R^3$ are hydrogen.

37. The emulsion concentrate of claim 34 wherein X is chlorine, X' and X'' are hydrogen, and $R^2$ and $R^3$ are chloromethyl.

38. The emulsion concentrate of claim 34 wherein X, X' and X'' are bromine, and $R^2$ and $R^3$ are chloromethyl.

39. The emulsion concentrate of claim 34 wherein X, X' and X'' are chlorine, and $R^2$ and $R^3$ are methyl.

40. The emulsion concentrate of claim 34 wherein X is chlorine, X' and X'' are bromine, and $R^2$ and $R^3$ are chloromethyl.

41. The emulsion concentrate of claim 32 wherein said organic solvent is substantially water immiscible.

42. The emulsion concentrate of claim 41 wherein said organic solvent has a flash point of at least 80° F. and a boiling point within the range of from about 300° to about 350° F.

43. A substantially non-aqueous flame retardant concentrate consisting essentially of (i) from about 20 to about 99 percent (by weight) of a flame retardant compound having the formula

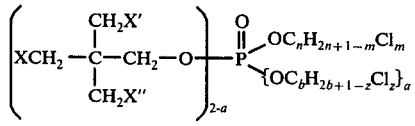

wherein X, X' and X'' are hydrogen, chlorine and bromine; $a$ is 0 to 1; $n$ is an integer of from 1 to 7; $m$ is an integer of from 1 to $n$; $b$ is an integer of from 1 to 7; and $z$ is an integer of from 1 to $b$; and (ii) from about 1 to about 80 percent (by weight) of an organic solvent.

44. The concentrate of claim 43 wherein $a$ is 1.

45. The concentrate of claim 44 wherein the flame retardant compound has the general formula.

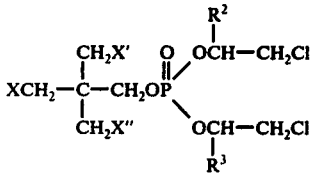
wherein X, X′ and X″ are as defined above; and $R^2$ and $R^3$ are independently selected from hydrogen, chlorine, methyl and chloromethyl.
* * * * *
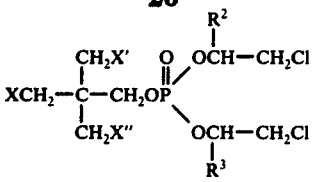
wherein X, X′ and X″ are as defined above; and $R^2$ and $R^3$ are independently selected from hydrogen, chlorine, methyl and chloromethyl.
* * * * *